US005689296A

United States Patent [19]

Heitmann et al.

[11] Patent Number: 5,689,296

[45] Date of Patent: Nov. 18, 1997

[54] DIGITAL PRINTING APPARATUS

[75] Inventors: Kjell A. Heitmann, Norwalk; Bruce E. Inpyn, Hamden, both of Conn.

[73] Assignee: Pitney Bowes Inc., Stamford, Conn.

[21] Appl. No.: 556,785

[22] Filed: Nov. 2, 1995

[51] Int. Cl.[6] ..... B41J 2/05

[52] U.S. Cl. ..... 347/50; 347/208; 361/784

[58] Field of Search ..... 347/50, 208, 209, 347/210, 211; 361/784, 785, 788, 790

[56] References Cited

U.S. PATENT DOCUMENTS

| | | | |
|---|---|---|---|
| 4,502,059 | 2/1985 | Blessington | 346/140 R |
| 4,810,852 | 3/1989 | Bakewell | 219/216 |
| 4,922,269 | 5/1990 | Ikeda | 346/140 R |
| 5,296,748 | 3/1994 | Wicklund et al. | 307/303.1 |
| 5,325,267 | 6/1994 | Ewing | 361/760 |
| 5,568,171 | 10/1996 | Keefe et al. | 347/58 |

*Primary Examiner*—Daniel P. Malley

*Attorney, Agent, or Firm*—Steven J. Shapiro; Melvin J. Scolnick

[57] ABSTRACT

A circuit connecting device for use with a digital printing apparatus is disclosed, the digital printing apparatus having a jet module assembly, a plurality of ink ejecting devices mounted in the jet module assembly, a corresponding plurality of ink ejecting nozzles formed on a nozzle plate mounted on an exterior of the jet module assembly, conduit means within the jet module assembly communicating between the ink ejecting devices and the nozzles, and a control electronics component for controlling the sequence of activation of the ink ejecting devices to cause ink to be ejected from the nozzles onto an image receiving medium during relative movement between the print head and the image receiving medium. The circuit connecting device has a pair of plates on which there is an electric trace pattern on the exterior surface of each plate and an electronic driver chip mounted on the exterior surface of each plate, and means for connecting the trace patterns to the electronic driver chips and to the control electronics component on the input end of the electric traces and to the ink ejecting devices on the output end of the electric traces, thereby eliminating all hard wiring between the control electronics component and the ink ejecting devices of the jet module assembly.

15 Claims, 4 Drawing Sheets

DIGITAL PRINTING APPARATUS

BACKGROUND OF THE INVENTION

The present invention relates generally to the field of digital printing devices, and more particularly to a device for connecting an ink jet module assembly to an external control electronics component that controls the sequence of operation of individual ink ejection devices in the jet module assembly to cause ink to be deposited on an image receiving medium in a desired image pattern.

In recent years digital printers have achieved a significant degree of popularity in various fields, particularly in the areas of desk top printing, such as computer printers, and also in other forms of convenience printing applications where convenience of printing from a relatively small, portable device having reasonably good speed and clarity of printed image are important characteristics. However, digital printing technology is constantly improving the desirable characteristics of digital printers and rendering them adaptable to an ever increasing variety of printing applications, as a result of which the demands placed upon the technology by these applications create problems not anticipated in the earlier stages of development of digital printers.

A brief review of the underlying principles of operation of digital printers will facilitate a better understanding of one of the problems encountered in heretofore known digital printers and the manner in which the present invention solves this problem. Typically, a digital printing device currently utilized in printing ordinary text includes a print head having a plurality of ink ejecting devices, such as one of those known in the art as bubble jet, piezo electric hot melt or wax, and a plurality of nozzles formed on a nozzle plate in a linear or bi-linear array that is equal to or slightly longer than the height of the text to printed. Each nozzle has associated therewith an ink ejecting device which functions, when appropriately actuated, to cause a minute droplet of ink to be ejected from the nozzle and deposited on an image receiving medium such as a sheet or strip of paper. A suitable control electronics component, typically a microprocessor, controls the sequence of actuation of the ink ejecting devices so that as the print head moves relative to the image receiving medium or vice versa, a desired image is formed on the image receiving medium.

It will be understood that if the image to be printed is higher than the length of the linear nozzle array on the nozzle plate, the image cannot be printed in a single pass of the print head relative to the image receiving medium. Thus, it becomes necessary for the print head to make two or more passes over the area where the image will be printed in order to print the desired image in a fragmented manner, that is, a portion of the image is printed in one pass, and another portion, or the remaining portion, as the case may be, is printed on the next pass, and the print head continues to make passes over this location on the image receiving medium until the full image has been printed.

However, a major problem encountered in situations where a graphic image is too tall to be printed in one pass of the paper or the print head, as the case may be, is where, for one reason or another, it is physically impossible to achieve more than one pass of the paper or the print head, with the result that if the image cannot be printed in one pass, it simply cannot be printed. This is the case with the printing application to which the present invention is related, that is, in high speed postal mailing machines. Heretofore, postage indicia was printed on envelopes in mailing machines utilizing curved or flat printing dies against which the envelopes were pressed while passing through the mailing machine, and an ink image of the indicia on the die was transferred to the envelopes during one pass of movement through the mailing machine. With this arrangement the image of the postage indicia, and often an accompanying advertising slogan, can be made to any desired size, which is limited only by the physical dimensions of the dies for the postage indicia and advertising slogan, with the result that the entire image can be printed in one pass of the envelope through the mailing machine.

One solution to the problem of printing an image having a height exceeding the length of the nozzle array of a digital print head is disclosed in prior U.S. patent application Ser. No. 421,651, filed on Apr. 13, 1995, in the name of Bruce Inpyn, and assigned to the assignee of this application. That application discloses various arrangements for providing a single print head with a plurality of conventional nozzle plates, each nozzle plate having an array of nozzles thereon, the nozzle plates being so arranged on the print head they are longitudinally and laterally offset relative to each other in such a way that the longitudinal projections of the opposite ends of a middle array of nozzles on one nozzle plate coincide with the adjacent ends of arrays of nozzles disposed on nozzle plates adjacent the opposite ends of the middle array of nozzles. The result of this arrangement is that when the ink ejecting devices are appropriately actuated by the control electronics, the three arrays of nozzles print a straight line, or any desired image, having a height equal to the combined length of the three arrays of nozzles.

Although this technique is clearly a viable solution to the problem of printing an image that is higher than the length of a single nozzle array on a digital print head, it has certain features of construction and operation that are undesirable from the standpoints of the complexity and cost of manufacturing both a single print head having such a large plurality of individual ink ejecting devices and the complex electrical trace patterns required therefor, as well as the highly complex software that is required to support the synchronous actuation of so many discontinuous ink ejecting devices.

Another solution is to provide a conventional print head, in which the linear array of nozzles on the nozzle plate is approximately ¾ths of an inch, with an array that is long enough to print whatever is the maximum height of the desired image, e.g., two inches. Although this arrangement would eliminate some of the problems inherent in the single print head with a plurality of conventional nozzle plates, it introduces other problems, particularly that of providing an extremely complex system of electrical connections between the control electronics component and the ink ejecting devices for controlling the time of actuation thereof. It should be understood that the clarity of an image printed by an ink digital print head is directly related to the diameter of the nozzles and the spacing between them, both of which are extremely small, being approximately 0.002 and 0.010 inches respectively. Thus, to print an image in the order of two inches high may require as many as several hundred nozzles and associated ink ejecting devices on a single print head.

It was found in early stages of development that it was very difficult to provide the necessary electrical connections for a print head having such a large number of nozzles and ink ejecting devices using conventional hard wiring techniques. Several problems were encountered with this technique, one being that the complexity of the necessary wiring harasses and the difficulty of making all of the solder connections between the control electronics and the ink ejecting devices made the finished print head very costly. Also, in the form of print head which utilizes hot wax ink, the ink ejecting devices normally operate in an environment in which the temperature is about 130° centigrade, which requires that the soldering technique be highly effective to ensure the reliability of all of the connections. Still further, it was very difficult to perform various types of circuit testing at various stages of manufacture to ensure that all of the electrical connections in the assembly were properly soldered so that all of the ink ejecting devices would operate. Thus, in many situations, circuit testing was deferred until the print head was fully assembled, and those that did not operate properly due to bad connections were simply discarded, resulting in considerable waste and contributing to a higher cost of acceptable finished print heads.

Another technique for interconnecting the control electronics with the ink ejecting devices is to use flexible harness wiring, generally referred to as "flex circuitry," in which a plurality of thin, very flexible, copper conductors are laterally developed on a non-conductive carrier, normally polyimide, so as to form a wide circuit, the width of the circuit depending on the number of conductors developed on the flex. One advantage of the flex is that driver chips for the individual ink ejection devices could be removed from the control electronics printed circuit board forming part of the control electronics component and placed directly on a portion of the flex circuit, thereby facilitating inspection of the connections between the driver chips and the flex circuit during the manufacturing stages of the print head. Also, the use of flex circuitry greatly simplified connecting the control electronics to the ink ejecting devices because the flex circuitry could have a connector attached which would mate with the printed circuit board of the control electronics package at one end and be soldered to the jet module assembly containing the ink ejecting devices at the other end by using hot bar soldering techniques.

A significant problem inherent in this arrangement is that, with the driver chips mounted directly on the flex circuitry, the connections between a flex circuit and the wire connections to the driver chips are subject to considerable stress every time the flex circuit moves during the various manufacturing and assembly stages of the digital printing apparatus, with the result that the integrity of some of the soldered connections unknown and possibly compromised.

Thus, it is apparent that there is a need for a digital printing device for printing large dimension images, whether of text or graphics or both, in which all of the nozzles on the nozzle plate are formed as a linear or bi-linear array to permit printing of the images in a single pass of relative motion between the print head and an image receiving medium, and in which the electrical interconnections between ink ejecting devices in the print head and the control electronics component therefor are formed in a manner which greatly simplifies manufacturing techniques, facilitates frequent testing and assures a high degree of reliability and minimal reject rate.

BRIEF SUMMARY OF THE INVENTION

The present invention greatly obviates if not entirely eliminates the foregoing problems by providing a print head for a digital printing apparatus which does not utilize either hard wiring or flex circuitry, but rather utilizes a molded circuit connecting device that is connected directly between a printed circuit board forming part of the control electronics component and a suitable connecting means formed on the jet module assembly containing the ink ejecting devices.

In some of its more limited aspects, the principles of the invention are embodied in a circuit connecting device which is used in a digital printing apparatus which includes a print head having a jet module assembly containing a plurality of ink ejecting devices, and a control electronics component including a printed circuit board for controlling the sequence of activation of the ink ejecting devices. In this environment, the invention is a circuit connecting deuce for connecting the printed circuit board to the ink ejecting devices, and comprises a pair of generally planar plates formed of relatively rigid dielectric material and having a pair of spaced apart electrical input and output sections and at least one intermediate control section, and mutually complementary means for securing the plates together in aligned face to face relationship. A plurality of electric traces are formed on an exterior surface of each of the plates which communicate between the electrical input section and the intermediate control section, and the intermediate control section and the output section respectively. There are means mounted on the electrical input and output sections for connecting the plurality of electric traces to the control electronics component and the ink ejecting devices of the print head respectively. An electronic driver chip having electrical input and output sections is mounted at the intermediate control section on each of the plates, the electrical input and output sections of the driver chip having means for connecting the driver chip to the plurality of electric traces, whereby the circuit connecting device forms an integral part of the electrical circuitry between the control electronics component and the ink ejecting devices without the use of any conventional electric wiring therebetween.

In some of its more limited aspects, the mutually complementary means for securing the plate together in aligned face to face relationship includes at least one locator pin formed along the inner surface of each of the plates adjacent the output section thereof and a correspondingly positioned aperture formed on each of the plates to receive the pin of the other plate to properly align the plates. Preferably, the locator pins are formed as a spaced apart pair of adjacent pins and apertures, and which fit within apertures in an upper portion of the jet module assembly which are larger than the locator pins and apertures to accommodate lateral relative movement from thermal expansion and contraction between the plates and the jet module assembly. Preferably, heat stake pins and apertures are formed at the corners of the plate to secure them together permanently.

The plurality of electric traces comprises a first plurality of electric traces extending substantially from the electrical input section to the intermediate control section on the exterior surfaces of the plates, and a second plurality of electric traces extending substantially from the electrical output section to the intermediate control section on the surfaces. The means for connecting the first plurality of electric traces to the control electronics component comprises a plurality of electrically conductive pins formed on the electrical input section of each of the plates and projecting outwardly therefrom, each of the pins being connected to the outer end of one of the first plurality of electric traces, the pins being adapted to be received within contact apertures formed on a printed circuit board of the control electronics component. And the means for connecting the second plurality of electric traces to the ink ejecting devices of the jet module assembly comprises a plurality of contact plates secured to the exterior surfaces of the plates, each of the plates being connected to the outer end of one of the second plurality of electric traces, the contact plates being adapted to mate with similar contact plates disposed in a recess of the jet module assembly into which the circuit connecting device is inserted.

Each of the plates is provided with at least one recess formed on the exterior surfaces of the plates at the intermediate location thereof for receiving the electronic driver chip associated with that plate, each of the recesses forming a correspondingly shaped protrusion on the opposite interior surfaces of the plates so that one board design can be used as a front and back, and that nesting of the boards results, and there are means mounted on the exterior surfaces of the plates surrounding the recesses for connecting the first and second plurality of electric traces to the electronic driver chips received in the recesses, this means constituting a plurality of electric contact plates mounted on the exterior surfaces of the plates adjacent the periphery of the recesses, each of the contact plates being connected to one of the first and second plurality of electric traces.

Finally, there is a grounding means disposed between the plates for grounding the ink jet module assembly when the plates are mounted thereon, which comprises an electrically conductive layer which covers substantially the area of the plates and is secured to the rear surface thereof, and the plurality of traces includes at least one trace connected to the input and output sections of the plate and having a contact thereon which extends through the plate to the grounding layer.

The circuit connecting device of the present invention solves several critical problems relating to multiple print head fabrication. First, it yields a completely testable unit that, once passed and accepted, continues onto final assembly. This could be set up so that automated testing on wire bonding equipment is done immediately after making electric contact from the electric traces on the circuit connecting device to the electric traces on the print head so that electrical integrity is verified.

The second problem is one of alignment for interconnection purposes. Circuit connecting devices have tolerances similar to those in any injection molded part. Features are incorporated in the circuit connecting device that align it to the jet module assembly and also align the multiple circuit connecting devices to each other. This eliminates fixturing and provides a highly repeatable simplified assembly process.

The third problem addressed by this invention is the interconnection of the jet module assembly to the main controller printed circuit board. This is accomplished automatically by the injection molded pins or fingers or other desired configuration on the circuit connecting device without having to add another connector to the circuit connecting device, thus eliminating the reliability problem of one more set of interconnects.

The fourth problem addressed by the invention is that of final testing. The only test required would be the control electronics to the circuit connecting device connection and the sealing of the jet module assembly to the body. Since current yield rates in production are spread almost equally among the fabrication process, the cost of rejecting a head at this point is significantly more than it would be at the jet module assembly level. Current heads can only be tested at this level and a lower reject cost results using this method.

Having briefly described the general nature of the present invention, it is a principal object thereof to provide a novel and effective circuit connecting device for use in a digital printing apparatus for connecting ink to the ejecting devices of a jet module assembly with control electronics that controls the operation of the ink ejecting devices.

Another object of the present invention is to provide a circuit connecting device for use as stated above which functions to interconnect the control electronics and the ink ejecting devices without the use of hard wiring or flex circuitry.

Still another object of the present invention is to provide a circuit connecting device for use as stated above in which driver chips are integrally mounted on the circuit connecting device to facilitate testing of the soldered connections to these components during the manufacture of the print head in which the circuit devices are used to minimize the extent of rejection of unacceptable print heads at the final assembly stage.

A still further object of the present invention is to provide a circuit connecting device for use as stated above which is constructed and arranged to minimize the extent of wire soldering in the connections between the control electronics and the driver chips, and between the driver chips and the ink ejecting devices of the jet module assembly so as to maximize the integrity of all of the connections and ensure that all of the ink ejecting devices in the final assembly will operate.

Yet another object of the present invention is to provide a circuit connecting device for use as stated above which includes means for permitting relative movement between portions of the circuit connecting device and adjacent portions of the ink jet module assembly resulting from thermal expansion of these parts which is not the same.

Still another object of the present invention is to provide a circuit connecting device for use as stated above which includes means incorporated within the circuit connecting device for grounding portions of the ink jet module assembly through the circuit connecting device to a suitable ground.

These and other objects and advantages of the present invention will become more apparent from an understanding of the following detailed description of a presently preferred embodiment of the present invention when considered in conjunction with the accompanying drawings.

DETAILED DESCRIPTION OF THE INVENTION

Figure 1:
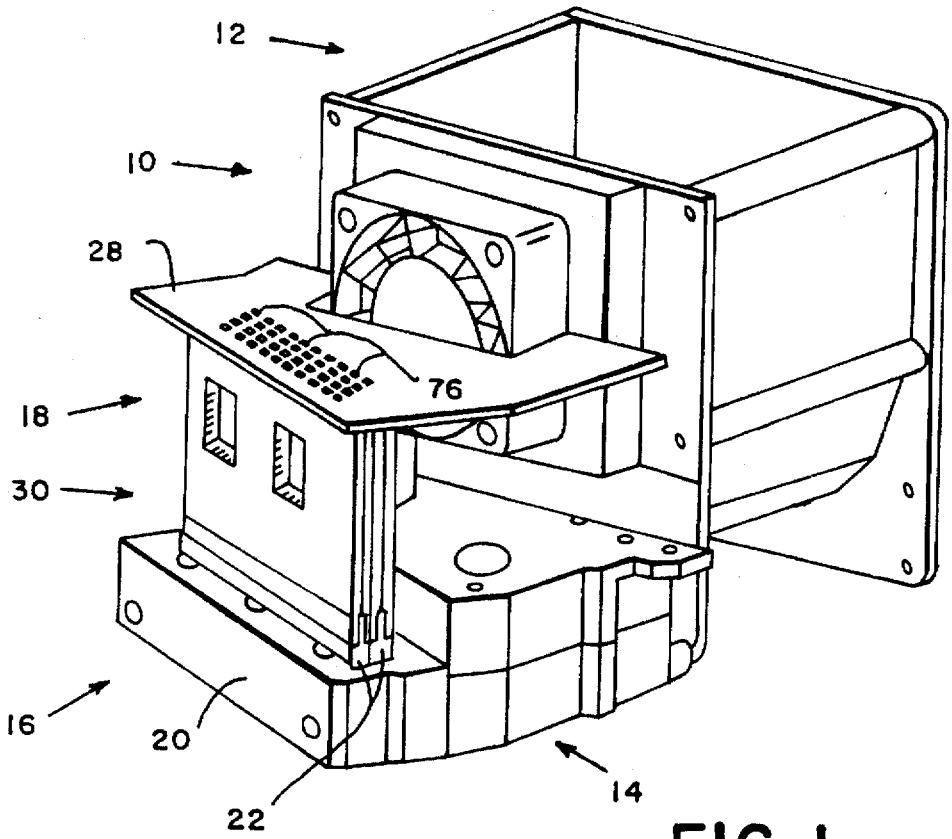
FIG. 1 is perspective view of a representative digital printing apparatus in which the circuit connecting device of the present invention would typically be utilized.

Referring now to the drawings, and particularly to FIG. 1 thereof, there is seen a representative digital printing apparatus, indicated generally by the reference numeral 10. It should be understood that the digital printing apparatus 10 can be adapted for use in a variety of digital printer applications, such as computer controlled desk top printers, printers associated with various forms of business machines, bar code marking, mailing equipment, product identification, addressing, and various other forms of high speed digital printers. In the application for which the present invention was designed, the digital printing device is intended for use in a mailing machine which is intended to print an image that is considerably larger than the size of image that can be printed with a conventional digital printing device, and where it is also necessary to print the image in a single pass of an envelope or strip or tape through the mailing machine.

Figure 2:
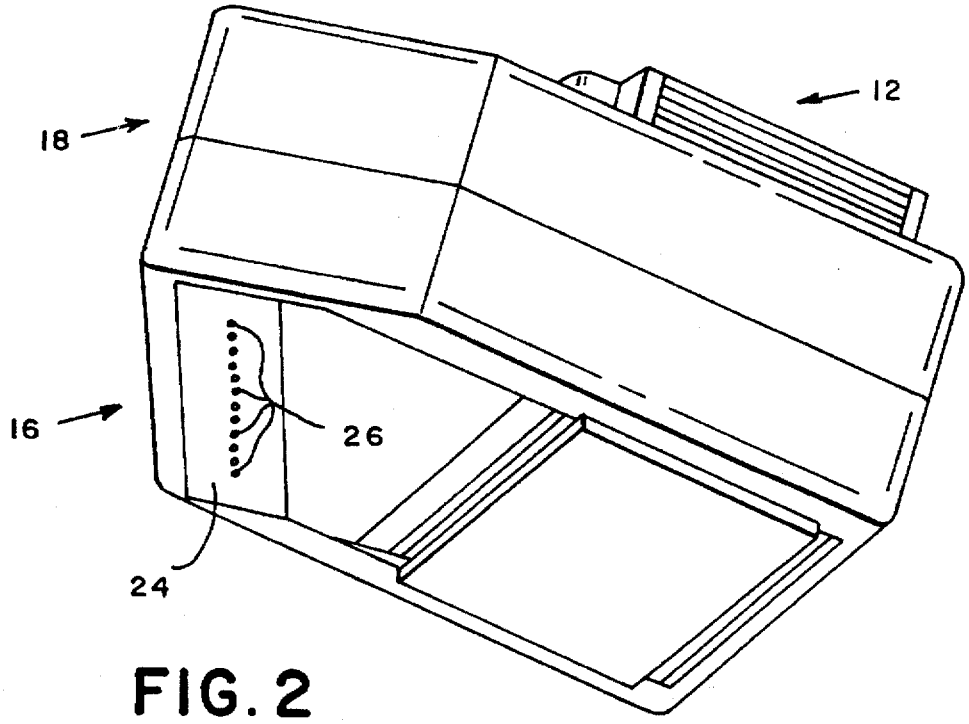
FIG. 2 is a perspective view of the apparatus shown in FIG. 1 but looking at the lower surface thereof to show the nozzle plate of the jet module assembly.

In the particular arrangement shown, the apparatus 10 includes a heating tank, indicated generally by the reference numeral 12, into which a large block of printing ink which is in a solid wax form. The wax is heated to a substantially viscous state where it is passed to a higher temperature smaller heating manifold, indicated generally by the reference numeral 14, through any suitable conduits which include flow control valves to regulate the flow of ink from the tank 12 to the manifold 14. The wax is further heated in the manifold 14 and is then fed to ink ejecting devices (further described below) contained in an ink jet module assembly, indicated generally by the reference numeral 16, the jet module assembly 16 forming part of a print head, indicated generally by the reference numeral 18. The jet module assembly 16 includes a body 20 and at least one, and preferably two as further explained below, jet module assemblies 22 received within the body 20 of the print head 18. As seen in FIG. 2, a nozzle plate 24 is mounted on the lower surface of the jet module assembly 16 and includes a linear or bi-linear array of minute openings 26 which form nozzles through which the ink is ejected onto an image receiving medium during relative movement between the print head 18 and the image receiving medium.

The digital printing apparatus 10 also includes a control electronics component which, in the apparatus as shown in FIG. 1, is represented by the printed circuit board 28. It should be understood that the control electronics component would typically includes other electronic control elements, such as a microprocessor memory and low lever logic, but for the purpose of fully understanding the construction and function of the present invention, the representation of the printed circuit board 28 is sufficient.

As will be explained in further detail below, the print head 18 of the apparatus 10 includes at least one circuit connecting device, indicated generally by the numeral 30, constructed in accordance with the principles of the present invention, and which is disposed between the jet module assembly 16 and the printed circuit board 28, and constitutes the electrical connecting means between the control electronics component as represented by the printed circuit board 24 and the ink ejecting devices in the jet module assembly 16 without the use of any hard electric wiring therebetween.

Figure 3:
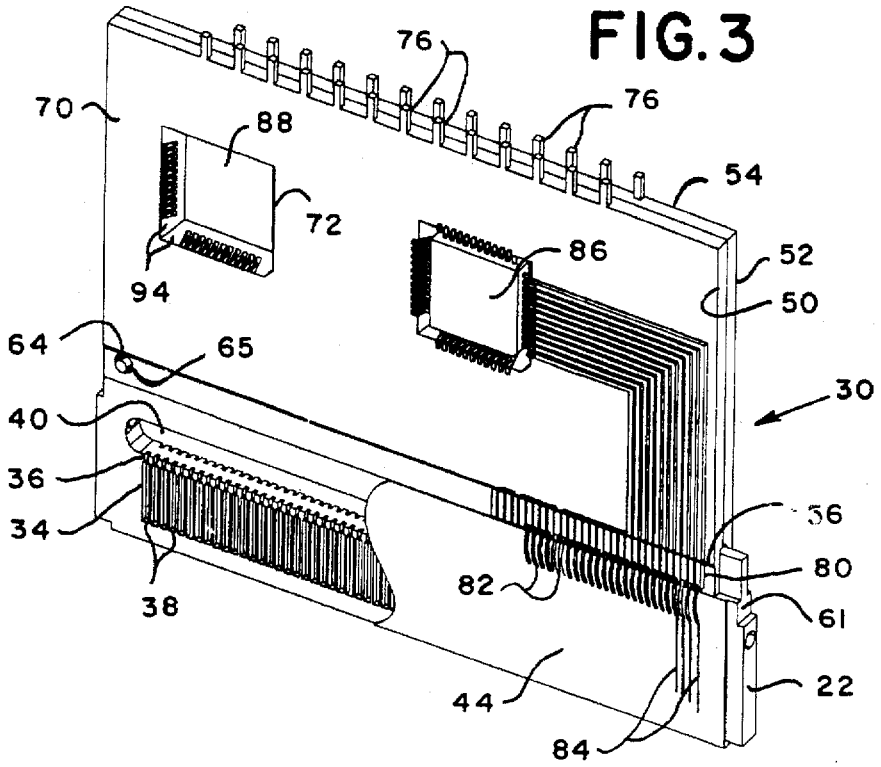
FIG. 3 is a perspective view of a circuit connecting device according to the present invention shown connected to one element of a typical jet module assembly.
Figure 4:
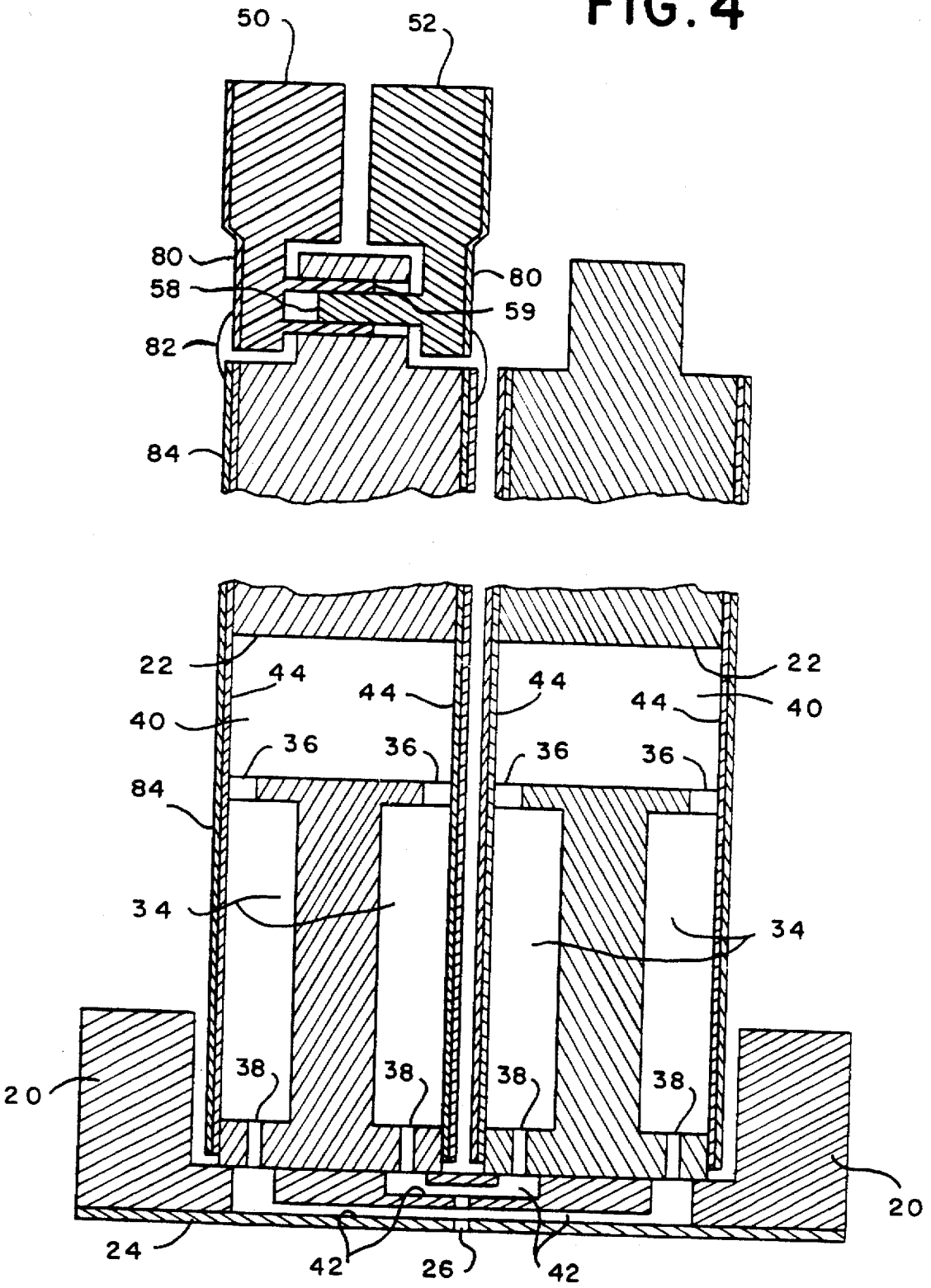
FIG. 4 is a fragmentary sectional view taken on the line 4—4 of FIG. 3 illustrating a representative form of ink ejecting device utilized in the jet module assembly.

FIGS. 3 and 4 illustrate one form of the ink ejecting devices located in the jet module assembly 16; it should be understood that this form is shown for illustrative purposes only, and any one of a variety of ink ejecting device configurations may be utilized with the present invention. Thus, the ink jet module assembly 22 contains a plurality of hollow, vertically oriented elongate chambers 34 lined up across the length of the jet module assembly 16 in evenly spaced relationship, each chamber having an inlet opening 36 at the upper end and an outlet opening 38 at the lower end. The inlet opening 36 of each chamber 34 communicates with a laterally extending channel 40 which connects in any suitable manner with the small heating tank 14 through suitable valves so that a constant supply of hot, liquid ink is supplied to the chambers 34.

In order to achieve the printing quality desired from the digital printing apparatus 10, it is necessary to have a large number of closely spaced nozzles extending in a linear or bi-linear array, the latter meaning that if the nozzles in one array cannot be spaced sufficiently close together to yield the desire resolution, a second row is provided in which the nozzles are slightly offset in the direction of the array from the nozzles in the first row so that the cumulative effect is twice the number of nozzles in a single array. In practice it has been found that 256 nozzles 26 disposed on the nozzle plate 20 in a linear or bi-linear array is a convenient number to work with from the standpoint of desired resolution, and also the fact that the electronic driver chips (further discussed below) which are mounted on the circuit connecting devices of the present invention are provided with 32 output terminals, which number is an even fraction of 256. It should be understood, however, that this is a representative configuration and that there are other combinations of nozzles and jet module assembly assemblies that can be used depending on the height and resolution needed for the image to be printed.

Since it is impossible to have 256 chambers 34 disposed in linear alignment in the ink jet module assembly 22, there are two such assemblies in the jet module assembly body 20, each assembly 22 having two rows of 64 chambers each. Thus, as best seen in FIG. 4, each ink jet module assembly 22 has two rows of chambers 34 disposed in side by side relationship, and the outlet opening 38 of each chamber 34 communicates with a conduit 42 formed in the jet module assembly body 20, all of the conduits 42 extending laterally of the body 20 to a central location and communicating with an individual nozzle 26 formed in the nozzle plate 24. It will be apparent from this construction that the 256 chambers 34 required to supply ink to the 256 nozzles are easily accommodated in the jet module assembly assemblies 22. It should be understood that if the high printing quality provided by the 256 nozzles in the nozzle plate 24 is not required, the print head 18 may be constructed with a jet module assembly 16 which has only 128 nozzles in the nozzle plate, in which case only one ink jet module assembly 22 is required.

In the form of the printing apparatus 10 illustrated in the drawings, the ink ejecting devices are of the piezo electric type, in which, as further seen in FIGS. 3 and 4, a piezo electric crystal 44 is formed as a sheet that covers substantially the entire front face of the ink jet module assembly 22, as shown in FIG. 3 by the unbroken portion of the piezo electric crystal 44. In a manner more fully described below, a portion of the piezo electric crystal 44 deflects slightly in response to a voltage being applied thereto, the extent of the expansion being sufficient to cause a minute quantity of ink to be ejected from the chamber 34 through the outlet opening 38 and into the conduit 42 associated with that chamber 34. This in turn causes a minute droplet of ink to be ejected from the nozzle 26 that is associated with that conduit.

With particular reference now to FIGS. 1 and 3 through 6, the circuit connecting device 30 of the present invention, comprises a pair of generally planar plates 50 and 52 which are formed of a suitable hard, moldable dielectric material, such as ULTEM™ or VECTRA™, or any other resin, each of the plates having at least one electrical input section 54 and one electrical output section 56. The plates 50 and 52 have suitable mutually complementary locating means, such as the pins 58 and immediately adjacent receptors 59 formed on the output section 56 of the plates 50 and 52 so that when they are pressed together, the pins 58 on each plate engage with a snap fit into the correspondingly located receptors 59 on the other plate to ensure proper longitudinal and lateral alignment of the plates 50 and 52. The pins 58 and receptors 59 are formed as a spaced apart pair of adjacent pins 58 and receptors 59 to ensure that the plates 50 and 52 are firmly secured together on opposite sides of the vertical center line. A pair of elongate openings 60 are formed in the upper portion 61 of the ink jet module assembly 22 which receive the locating pins 58 and the receptors 59 when the plates 50 and 52 are assembled onto the ink jet module assembly 22 as seen in FIG. 3. The openings 60 are longer then the space occupied by the pin-receptor assembly received therein in order to accommodate a certain amount of relative longitudinal movement of the plates 50 and 52 with respect to the upper portion 61 of the ink jet module assembly 22 resulting from thermal expansion and contraction of these parts, which is not the same. It should be understood that during a printing operation, the area of interconnection between the plates 50 and 52 and the upper portion of the jet module assembly may reach substantially high operating temperatures, in the order of 130° C., and if the plates 50 and 52 and the upper portion 61 of the ink jet module assembly 22 cannot move relative to each other to accommodate the thermal expansion and contraction, it is possible, if not probable, that portions of the plates 50 and 52 will warp and cause sufficient stress in the electrical interconnects (yet to be described below) between the plates 50 and 52 and the jet module assembly that they could break and interrupt the circuit to one or several of the ink ejecting devices.

Each plate 50 and 52 is provided with pin 62 adjacent to, but on opposite sides, of the vertical center line of the plate. A pair of apertures 63 is formed in the upper portion 61 of the ink jet module assembly 22 which are appropriately spaced so that the pin 62 on each plate fits into one of the apertures 63 so as to ensure proper alignment between the assembly of the plates 50 and 52 with the upper portion 61 of the ink jet module assembly 22. Since the pins 62 and apertures 63 are substantially at the center of these parts, the pins 62 and apertures 63 can form a tight fit to ensure the desired alignment since there is no relative movement from thermal expansion or contraction between the assembly of the plates 50 and 52 and the upper portion 61 of the jet module assembly at this location.

In addition to the locator pins 58 and apertures 59, the plates 50 and 52 are also provided with a heat stake pin 64 adjacent one corner and an aperture 65 adjacent the other corner, and the upper portion 61 of the ink jet module assembly 22 is provided with a pair of corner apertures 66 which, again, are larger than the pins 64 in order to accommodate the aforementioned relative longitudinal movement between the plates 50 and 52 and the upper portion 61 of the ink jet module assembly 22. The pins 64 provide a permanent interconnect between the assembly of the plates 50 and 52 and the upper portion of the ink jet module assembly 22 because these pins are heat staked in the mating apertures 65 in the opposite plate, thereby preventing the plates 50 and 52 from being disassembled without breaking them apart and ensures a permanent and reliable assembly.

Figure 6:
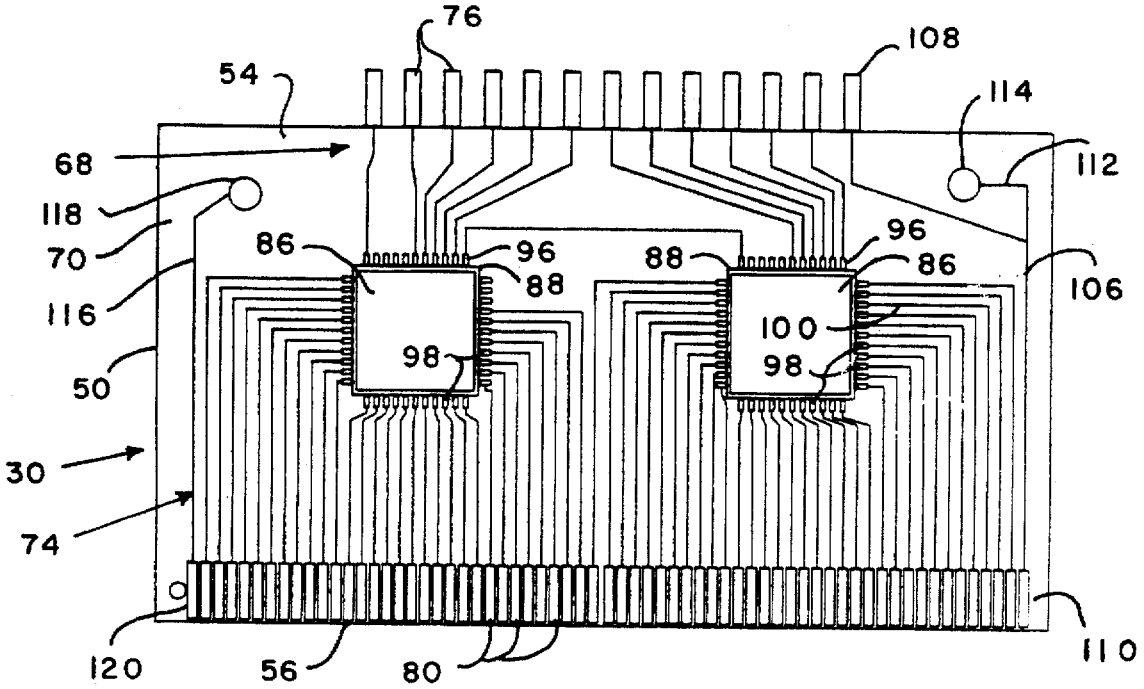
FIG. 6 is a plan view of the electrical trace pattern developed on the exterior surfaces of the circuit connecting device of the present invention.

As best seen in FIG. 6, a first plurality of electric traces, indicated generally by the reference numeral 68, is developed by suitable well known technology to an exterior surface 70 of each plate 50 and 52, and extends substantially from the electrical input section 54 to an intermediate control location 72 on the surface 70. A second plurality of electric traces, indicated generally by the reference numeral 74, is also suitably affixed to the exterior surface 70 of each plate and extends substantially from the electrical output section 56 to the intermediate control location 72. It should be noted that in the preferred embodiment of the invention illustrated in the drawings, there are two such intermediate control locations 72, although this is not critical to the invention. It should also be understood that the patterns of the first and second plurality of electric traces 68 and 74 has been partially omitted from FIG. 3 for the sake of clarity in this figure.

A plurality of electrically conductive contact pins 76 are mounted on the edge 54 of each plate 50 and 52 so as to project outwardly therefrom, each of the pins 76 being connected to the outer end of one of the first plurality of electric traces 68. As seen in FIG. 1, the contact pins 76 are adapted to be received within contact apertures 78 formed on the printed circuit board 28 or in a suitable connector. Also, a plurality of electrically conductive print head contact pads 80 are affixed to the exterior surfaces 70 of the plates 50 and 52, each of the print head contact pads 80 being connected to the outer end of one of the second plurality of electric traces 74. Referring back to FIGS. 3 and 4, it will be seen that the print head contact pads 80 are connected by small wires 82 to conductive traces 84 which extend down the face of the piezo electric crystals 44 adjacent to each of the chambers 34, so that when selected conductive traces 84 are energized, the piezo electric crystal 44 deflects slightly in the area of the selected traces 84 to cause the deflection of the piezo electric crystal mentioned above that provides the minute pressure required to eject ink from the chambers 34 associated with the energized traces 84.

In order to control the proper operation of the individual ink ejecting devices in the jet module assembly assemblies 22, it is necessary to provide a plurality of electronic driver chips 86, of which only one is illustrated in FIG. 3. Essentially, the driver chip 86 functions as a signal amplifier and diverter, and takes a low voltage signal from the control electronics components and greatly increases the voltage and also multiplexes the signal to the correct channel in accordance with which ink ejecting device must fire at a given instant in order to produce the desired image. In other words, the driver chip functions in a manner similar to a relay in that it accepts a low voltage signal to close electronic switches in order to feed a higher voltage through selected circuits as determined by the control electronics.

Figure 5:
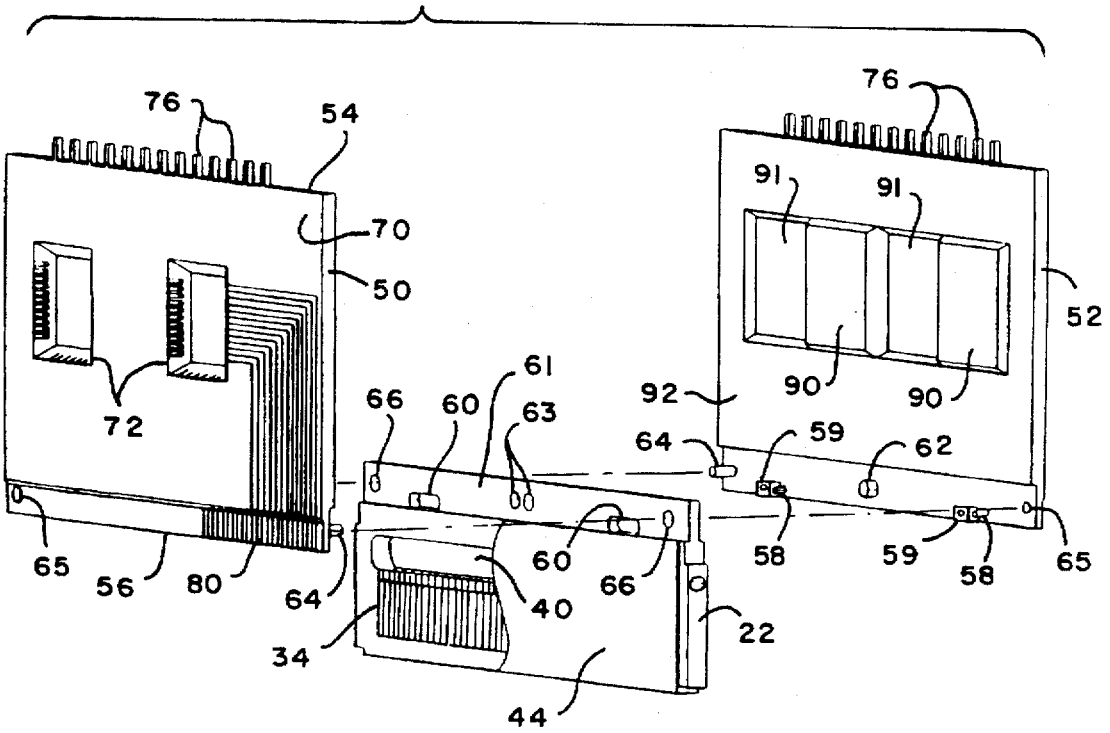
FIG. 5 is an exploded view of the parts shown in FIG. 3.

Thus, as best seen in FIGS. 3 and 5, it will be seen that the aforementioned intermediate control locations 72 are actually configured as sections of the body of the plate 50 which are displaced from the remainder of the body so as to form a depression 88 from the exterior surface 70 of the plate 50, and a corresponding protrusion 90 (FIG. 5) on the interior surface 92. Since the depression 88 on the exterior surface 70 occupies the full thickness of the plate 50, a depression on one side of the plate 50 necessitates a protrusion on the other.

As seen in the plate 52 in FIG. 5, each plate is provided with a pair of depressions 91 formed on the interior surface 92 which accommodate the protrusions 90 on the other plate. However, these depressions 91 do not cause protrusions on the exterior surfaces 70 of the plates because they occupy only one half of the thickness of the plates, which is all that is required since the plates are slightly spaced apart when assembled together. This arrangement permits the exterior surfaces of the plates to remain flat, which permits the various traces to be developed on the exterior surfaces with much less difficulty than would be the case if the exterior surfaces had protrusions corresponding to those resulting from the depressions 86 which receive the driver chips. It should be noted in FIG. 5 that the protrusions 90 and interior surface 92 are actually seen on the adjacent plate 52 (it being understood that the construction of both plates 50 and 52 is identical). Each depression 88 is provided with a plurality of side walls 94, the number of which will depend on the shape of the chip driver 86, which have an inwardly sloping configuration, although this configuration is not essential to the functioning of the electrical interconnect.

A plurality of electrically conductive input contact pads 96 (FIG. 6) are developed on the surface 70 of the plates 50 and 52 along the upper edge of the depressions 88 and are connected to the inner ends of the first plurality of electric traces 68. A plurality of electrically conductive output contact pads 98 are developed on the surface 70 of the plates 50 and 52 and are connected to the inner ends of the second plurality of electric traces 74.

As seen in FIGS. 3 and 6, an electronic driver chip 86 is positioned within the recesses 88, the driver chip 86 including a plurality of conductors 100 extending outwardly from all sides of the body of the driver chip which are adapted to be suitably connected to the contact input and output contact pads 96 and 98 respectively. It will be seen that there are 11 such conductors 100 on the left and bottom sides of the driver chip 86 and 10 on the right side, which adds up to 32 conductors on the driver chip 86 that are connected to a corresponding number of contact pads 98 corresponding to the 32 traces making up the second plurality of electric traces 74. Since there are two electronic driver chips 86 on the plate 50, there will be 64 print head contact pads 80 along the electrical output sections 56 of the plates 50 and 52 together, thereby providing 128 print head contact pads 80 for the entire circuit connecting device 30. And since, as seen in FIG. 1, two circuit connecting devices 30 are placed in side by side relationship in the print head 18, the preferred number of 256 ink ejecting device can be provided in the body 20 of the ink jet module assembly 16. The driver chips 86, when two are provided as in the preferred arrangement, are connected in parallel and signals from the control electronics provide power and determine the nozzle firing order. An individual control line is provided to each driver chip 86 to allow sequencing and subsequent firing of the driver chips.

Figure 7:
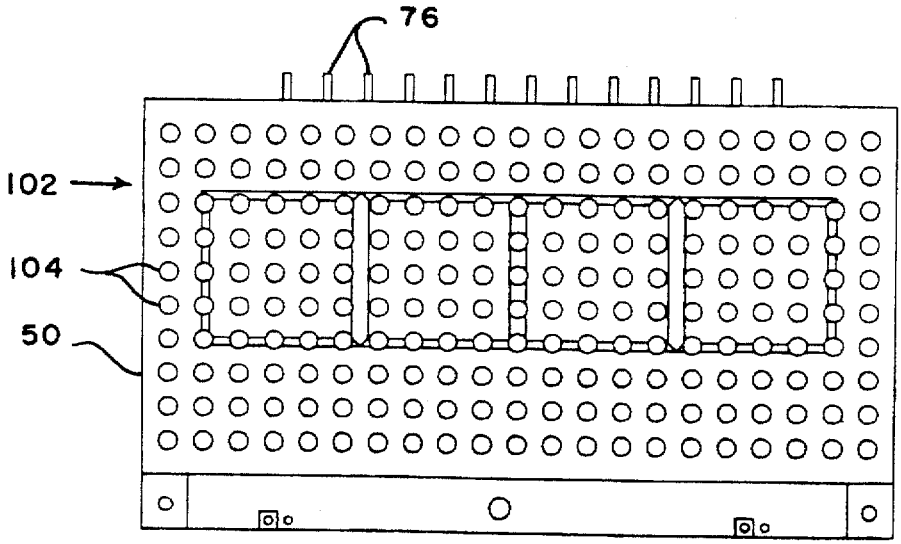
FIG. 7 is a plan view of the ground plate secured to the interior surface of each of the plates constituting the circuit connecting device.

As seen in FIG. 7, the plates 50 and 52 each include a combined ground and heat dissipating means, designated generally by the reference numeral 102, which is formed as a generally rectangular electrically conductive layer that covers substantially the entire area of the plate 50 as shown in FIG. 7, except for that portion of the interior surface 92 opposite the location of the output contact pads 80. The ground layer 102 has a plurality of perforations 104 therein to equalize the thermal expansion rates of the front and rear surfaces to prevent warpage of the plate 50 during soldering, and follows the contour of the plate 50 where the surface 92 protrudes outwardly. The ground layer 102 is suitably connected to the inner surface 92 of each plate by a suitable plating or bonding process.

Referring to FIG. 6, an electric trace 106 extends from an input pin 108 across the plate 50 to an output pad 110 adjacent the print head output pads 80, and is suitably connected to the upper portion 61 of the ink jet module assembly 22 in order to connect it to a suitable ground. A lateral trace 112 leads to a contact 114 which extends through the plate 50 to the ground layer 102, thereby connecting one side of the ground layer 102 to the same ground. On the opposite side of the plate 50 from the trace 106 is another trace 116 which extends from another contract 118 which also extends through the plate 50 to the ground layer 102. The trace 116 is connected to another output pad 120 which is connected to the ink jet module assembly 22 at the opposite end from where the output pad 110 is connected, thereby effectively grounding both sides of the ink jet module assembly 22 to provide a more uniform ground path for the ink jet module assembly in view of the high voltage needed to activate the ink ejecting devices.

As briefly mentioned above, the ground layer 102 also functions to dissipate heat which is generated by the electronic driver chips 86, by conducting the heat away from the driver chips 86 to the border portions of the plates 50 and 52, from where it is dissipated into the adjacent air since the plates 50 and 52 are slightly spaced apart.

It should be apparent from the foregoing that the circuit connecting device 30 of the present invention provides a convenient, inexpensive and unique device for interconnecting the electronics component package of a digital printing apparatus with the jet module assembly thereof without having to resort to conventional hard wiring techniques and which provides all of the advantages set forth above. The circuit connecting device 30 is assembled into the digital printing apparatus 10 by first assembling the jet module assembly assemblies 22 into the body 20 of the ink jet module assembly 16 so that the outlet openings 38 communicate with the lateral conduits 42 formed in the body 20. The plates 50 and 52 forming one circuit connecting device 30 are then assembled to the upper portion 61 of one of the jet module assembly assemblies 22 by passing the interconnecting means tabs 58 formed on the interior surfaces 92 of the plates 50 and 52 through the apertures 64 in the upper portion 61 of the ink jet module assembly 22, and passing the locator pins 60 formed on each plate 50 and 52 through the corresponding apertures 66 formed in the upper portion 61 of the ink jet module assembly 22. The plates 50 and 52 are then attached together by heat staking the pins 64 in the apertures 65 after assembling the plates 50 and 52 to the ink jet module assembly 22. The wires 82 are then connected to the print head contact pads 80 and the individual circuits 84 on the surface of the piezo electric plate 44 by any suitable soldering or bonding technique, after which the printed circuit board 28 is lowered into place over the upper ends of the plates 50 and 52 until the contact pins or fingers 76 on the electrical input sections 54 of each plate are disposed within the corresponding apertures 78. The assembly is completed by soldering the pins 76 into these apertures.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. In a digital printing apparatus including a print head having an ink jet module assembly containing a plurality of ink ejecting devices and a control electronics component including a printed circuit board for controlling the sequence of activation of the ink ejecting devices, a circuit connecting device for connecting the printed circuit board to the ink ejecting devices, said circuit connecting device comprising:

A. a pair of generally planar plates formed of relatively rigid dielectric material and having a pair of spaced apart electrical input and output sections and at least one intermediate control section, and mutually complementary means for securing said plates together in aligned face to face relationship, B. a plurality of electric traces formed on an exterior surface of each of said plates and communicating between said electrical input section and said intermediate control section, and said intermediate control section and said out section respectively, C. means mounted on said electrical input and output sections for connecting said plurality of electric traces to the control electronics component and the ink ejecting devices of the print head respectively, and D. an electronic driver chip having electrical input and output sections mounted at said intermediate control section on each of said plates, said electrical input and output sections having means for connecting said driver chip to said plurality of electric traces, whereby said circuit connecting device forms an integral part of the electrical circuitry between the control electronics component and the ink ejecting devices without the use of any conventional electric wiring therebetween.

2. A circuit connecting device as set forth in claim 1 wherein said means for securing said plates together includes at least one locator pin on the inner surface of each of said plates adjacent the output section thereof and a correspondingly positioned aperture each of said plates adjacent the output section thereof for receiving the locator pin of the other plate to properly align said plates when said plates are assembled together in face to face relationship.

3. A circuit connecting device as set forth in claim 2 wherein said locator pins and apertures are formed as a spaced apart pair of adjacent locator pins and apertures to ensure proper longitudinal and lateral alignment of said plates.

4. A circuit connecting device as set forth in claim 3 wherein said locator pins and apertures are received within apertures in an upper portion of the jet module assembly which are larger than said locator pins and apertures to accommodate relative longitudinal movement from thermal expansion and contraction between said plates and the ink jet module assembly.

5. A circuit connecting device as set forth in claim 2 wherein said means for securing said plates together further includes at least one heat stake pin on each of said plates and at least one aperture on each of said plates for receiving the heat stake pin of the other plate whereby when said pins are heat staked in said apertures said plates are permanently connected together.

6. A circuit connecting device as set forth in claim 1 wherein each of said plates is provided with a pin on the output sections adjacent to the center line thereof, each of said pins being adapted to be received in correspondingly located apertures in the upper portion said ink jet module assembly to ensure that said plates are properly longitudinally and laterally aligned with said upper portion of said ink jet module assembly.

7. A circuit connecting device as set forth in claim 1 wherein said plurality of electric traces comprises A. a first plurality of electric traces extending substantially from said electrical input section to said intermediate control section on said surfaces, and B. a second plurality of electric traces extending substantially from said electrical output section to said intermediate control section on said surfaces.

8. A circuit connecting device as set forth in claim 7 wherein said means for connecting said first plurality of electric traces to the control electronics component comprises a plurality of electrically conductive contact pins mounted on said electrical input section of each of said plates and projecting outwardly therefrom, each of said pins being connected to the outer end of one of said first plurality of electric traces, said pins being adapted to be received within contact apertures formed on the printed circuit board of the control electronics component.

9. A circuit connecting device as set forth in claim 8 wherein said means for connecting said second plurality of electric traces to the ink ejecting devices of the jet module assembly comprises a plurality of contact plates secured to said exterior surfaces of said plates along said electrical output sections, each of said plates being connected to the outer end of one of said second plurality of electric traces, said contact plates being suitably connected to an electric circuit formed on a piezo electric crystal which is part of the ink ejection devices.

10. A circuit connecting device as set forth in claim 9 wherein each of said plates is provided with A. at least one recess formed on said exterior surfaces of said plates at said intermediate control location for receiving said electronic driver chip associated with said plate, and B. means mounted on said exterior surfaces of said plates for connecting said first and second plurality of electric traces to said electrical input and output sections respectively of said electronic driver chip received in said recesses.

11. A circuit connecting device as set forth in claim 10 wherein said means for connecting said first and second plurality of electric traces to said electrical input and output sections respectively of said electronic driver chip comprises a plurality of electric contact plates mounted on the exterior surfaces of said plates at the inner ends of said first and second plurality of electric traces adjacent the periphery of said recesses, each of said contact plates being connected to one of said first and second plurality of electric traces.

12. A circuit connecting device as set forth in claim 1 further including means disposed between said plates for grounding the ink jet module assembly when said plates are mounted on said ink jet module assembly.

13. A circuit connecting device as set forth in claim 12 wherein said grounding means comprises an electrically conductive layer which covers substantially the area of said plates and is secured to the rear surface thereof, said plurality of traces including at least one trace connected to said input and output sections of said plate and having a contact thereon which extends through said plate to said grounding layer.

14. A circuit connecting device as set forth in claim 1 wherein said intermediate control sections are defined by a recess formed in said plates extending from said exterior surfaces thereof toward the opposite surfaces, said recess extending for substantially the full thickness of said plates, thereby defining corresponding protrusions extending outwardly from said opposite surfaces of said plates.

15. A circuit connecting device as set forth in claim 14 wherein said plates are provided with recesses formed in said plates extending from said opposite surfaces toward said exterior surfaces and being disposed adjacent said protrusions on said opposite surfaces of said plates, said last mentioned recesses extending for substantially one half of the thickness of said plates, thereby permitting said exterior surfaces of said plates to remain flat.

* * * * *